US009145523B2

(12) United States Patent
Choi et al.

(10) Patent No.: US 9,145,523 B2
(45) Date of Patent: Sep. 29, 2015

(54) UPGRADING OF HYDROCARBONS BY HYDROTHERMAL PROCESS

(71) Applicant: Saudi Arabian Oil Company, Dhahran (SA)

(72) Inventors: Ki-Hyouk Choi, Dhahran (SA); Ashok K. Punetha, Dhahran (SA); Mohammed R. Al-Dossary, Dhahran (SA); Mohammad F. Aljishi, Qatif (SA)

(73) Assignee: SAUDI ARABIAN OIL COMPANY (SA)

( * ) Notice: Subject to any disclaimer, the term of this patent is extended or adjusted under 35 U.S.C. 154(b) by 0 days.

(21) Appl. No.: 14/688,007

(22) Filed: Apr. 16, 2015

(65) Prior Publication Data

US 2015/0218465 A1 Aug. 6, 2015

Related U.S. Application Data

(62) Division of application No. 12/881,900, filed on Sep. 14, 2010.

(51) Int. Cl.
*C10G 47/32* (2006.01)
*C10G 65/10* (2006.01)

(52) U.S. Cl.
CPC ..... *C10G 65/10* (2013.01); *C10G 47/32* (2013.01)

(58) Field of Classification Search
CPC ..... C10G 47/32; C10G 11/20; C10G 9/34; C10G 9/40
See application file for complete search history.

(56) References Cited

U.S. PATENT DOCUMENTS

2009/0145805 A1* 6/2009 Choi ..... 208/106

* cited by examiner

*Primary Examiner* — Randy Boyer
*Assistant Examiner* — Juan Valencia
(74) *Attorney, Agent, or Firm* — Bracewell & Giuliani LLP; Constance Gall Rhebergen

(57) ABSTRACT

A hydrocarbon feedstock upgrading method is provided. The method includes supplying the hydrocarbon feedstock, water and a pre-heated hydrogen donating composition to a hydrothermal reactor where the mixed stream is maintained at a temperature and pressure greater than the critical temperatures and pressure of water in the absence of catalyst for a residence time sufficient to convert the mixed stream into a modified stream. The hydrogen donating composition is preheated and maintained at a temperature of greater than about 50° C. for a period of at least about 10 minutes. The modified stream includes upgraded hydrocarbons relative to the hydrocarbon feedstock. The modified stream is then separated into a gas stream and a liquid stream and the liquid stream is separated into a water stream and an upgraded hydrocarbon product stream.

8 Claims, 6 Drawing Sheets

UPGRADING OF HYDROCARBONS BY HYDROTHERMAL PROCESS

RELATED APPLICATIONS

This application is a divisional application of U.S. patent application Ser. No. 12/881,900, filed on Sep. 14, 2010 which is incorporated herein by reference in its entirety.

FIELD OF THE INVENTION

This invention relates to a method and apparatus for upgrading a hydrocarbon feedstock. More specifically, the present invention relates to a method and apparatus for upgrading a hydrocarbon feedstock with supercritical water.

BACKGROUND OF THE INVENTION

Petroleum is an indispensable source for energy and chemicals. At the same time, petroleum and petroleum based products are also a major source for air and water pollution. To address growing concerns with pollution caused by petroleum and petroleum based products, many countries have implemented strict regulations on petroleum products, particularly on petroleum refining operations and the allowable concentrations of specific pollutants in fuels, such as, sulfur content in gasoline fuels. For example, motor gasoline fuel is regulated in the United States to have a maximum total sulfur content of less than 15 ppm sulfur.

Due to its importance in our everyday lives, demand for petroleum is constantly increasing and regulations imposed on petroleum and petroleum based products are becoming stricter. Available petroleum sources currently being refined and used throughout the world, such as, crude oil and coal, contain much higher quantities of impurities (such as, compounds containing sulfur). Additionally, current petroleum sources typically include large amounts of heavy hydrocarbon molecules, which must be converted to lighter hydrocarbon molecules through expensive processes like hydrocracking, for eventual use as a transportation fuel.

Current conventional techniques for petroleum upgrading include hydrogenative methods which require an external source of hydrogen in the presence of a catalyst, such as hydrotreating and hydrocracking. Thermal methods performed in the absence of hydrogen are also known in the art, such as coking and visbreaking.

Conventional methods for petroleum upgrading, however, suffer from various limitations and drawbacks. For example, hydrogenative methods typically require large amounts of hydrogen gas to be supplied from an external source to attain desired upgrading and conversion. These methods can also suffer from premature or rapid deactivation of catalyst, as is typically the case during hydrotreatment of a heavy feedstock and/or hydrotreatment under harsh conditions, thus requiring regeneration of the catalyst and/or addition of new catalyst, which in turn can lead to process unit downtime. Thermal methods frequently suffer from the production of large amounts of coke as a byproduct and a limited ability to remove impurities, such as, sulfur and nitrogen. This in turn results in the production of large amount of olefins and diolefins, which may require stabilization. Additionally, thermal methods require specialized equipment suitable for severe conditions (such as, compounds containing sulfur), require the input of significant energy, thereby resulting in increased complexity and cost.

As noted above, the provision and use of an external hydrogen supply is both costly and dangerous. Alternative known methods for providing hydrogen by in-situ generation method, including partial oxidation, and production of hydrogen via a water-gas shift reaction. Partial oxidation converts hydrocarbons to carbon monoxide, carbon dioxide, hydrogen and water, as well as partially oxidized hydrocarbon molecules such as carboxylic acids; however, the partial oxidation process also removes a portion of valuable hydrocarbons present in the feedstock and can cause severe coking.

Thus, there exists a need to provide a process for the upgrading of hydrocarbon feedstocks that do not require the use of a catalyst or an external hydrogen supply. Methods described herein are suitable for the production of more valuable hydrocarbon products having one or more of a higher API gravity, higher middle distillate yields, lower sulfur content, and/or lower metal content via upgrading with supercritical water without requiring any use of a hydrothermal reactor catalyst or the external supply of hydrogen.

SUMMARY

The current invention provides a method and apparatus for the upgrading of a hydrocarbon feedstock with supercritical water, wherein the upgrading method specifically excludes the use of a hydrothermal catalyst or the use of an external supply of hydrogen.

In one aspect, a method of upgrading a hydrocarbon feedstock is provided. The method includes the steps of supplying a mixed stream that includes the hydrocarbon feedstock, water and a pre-heated hydrogen donating composition to a hydrothermal reactor. The mixed stream is maintained in the hydrothermal reactor at a pressure greater than the critical pressure of water and a temperature greater than the critical temperature of water. Prior to being supplied to the hydrothermal reactor, the hydrogen donating composition is preheated to a temperature of greater than about 50° C. and maintained at said temperature for a period of at least about 10 minutes. The mixed stream is reacted in the hydrothermal reactor in the absence of catalyst for a residence time sufficient to convert the mixed stream into a modified stream, wherein the modified stream includes upgraded hydrocarbons relative to the hydrocarbon feedstock. The modified stream is separated into a gas stream and a liquid stream, and the liquid stream is separated into a water stream and an upgraded hydrocarbon product stream.

In certain embodiments, the hydrogen donating composition is a bottoms stream from a process selected from the group consisting of hydrocracking, coking, visbreaking, hydrotreating, or catalytic cracking. In certain embodiments, the hydrogen donating composition is produced by the following steps: supplying a low grade hydrocarbon feedstock to a reactor, wherein the reactor being selected from the group consisting of a hydrocracker, a coker, a visbreaker, a hydrotreater, or a catalytic cracker, wherein said low grade hydrocarbon feedstock is converted to intermediate stream, and separating the intermediate stream into a hydrocarbon stream that includes upgraded hydrocarbons and a bottoms stream that includes the hydrogen donating composition. Preferably, the method does not include the step of supplying hydrogen gas to the hydrothermal reactor.

In certain embodiments, the hydrothermal reactor pressure in maintained at greater than about 24 MPa, and the hydrothermal reactor temperature in maintained at greater than about 395° C. Alternatively, the hydrothermal reactor pressure is maintained at between about 24 and 26 MPa, and the hydrothermal reactor temperature is maintained at between about 400° C. and 450° C.

In certain embodiments, prior to mixing the hydrocarbon feedstock, hydrogen donating composition and water, the hydrocarbon feedstock is pre-heated to a temperature of up to about 250° C., the hydrogen donating composition is pre-heated to a temperature of up to about 500° C., and the water is pre-heated to a temperature of up to about 650° C. In certain embodiments, the hydrogen donating composition is pre-heated to a temperature of between about 120° C. and 350° C., and is maintained at said preheated temperature for a period of between about 10 and 90 minutes.

In another aspect, a method for upgrading a hydrocarbon feedstock is provided. The method includes the steps of supplying a low grade first hydrocarbon feedstock to a first reactor selected from the group consisting of a hydrocracker, a coker, a visbreaker, a hydrotreater, and a catalytic cracker, wherein said first reactor configured for the upgrading of the first hydrocarbon feedstock, and recovering an intermediate hydrocarbon stream from the first reactor. The intermediate hydrocarbon stream is recovered and separated into a light hydrocarbon stream and a bottoms stream. The bottoms stream is pre-heated to a temperature of at least about 120° C. for a period of at least about 10 minutes and mixed with a hydrocarbon feedstock, and water to form a reaction mixture. The reaction mixture is supplied to a main hydrothermal reactor that is maintained at a temperature greater than about 374° C. and a pressure greater than about 22.06 MPa for a residence time in the hydrothermal reactor of between about 30 seconds and 60 minutes to produce modified stream comprising upgraded hydrocarbons. The main hydrothermal reactor does not include a catalyst. The modified stream is withdrawn from the main hydrothermal reactor and separated into a gaseous phase and a liquid phase, and the liquid phase is separated into a water stream and an upgraded hydrocarbon stream, wherein the upgraded hydrocarbon stream has at least one improved physical property as compared with the hydrocarbon feedstock, the physical properties selected from sulfur content, nitrogen content, metal content, coke content, and API gravity.

DETAILED DESCRIPTION OF THE INVENTION

Figure 1:
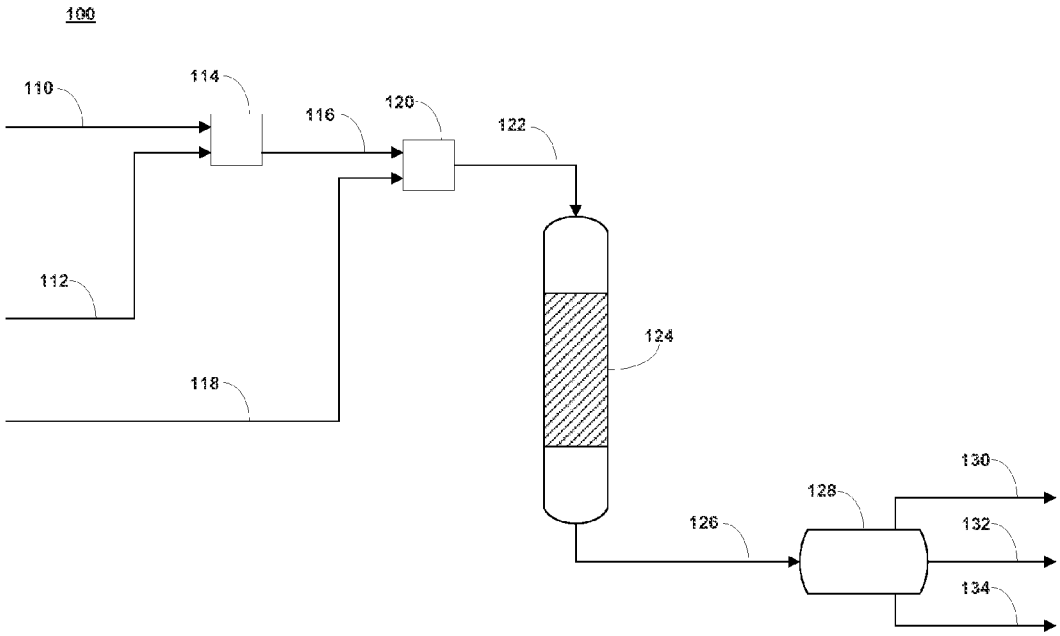
FIG. 1 provides a schematic diagram of one embodiment of the method of upgrading a hydrocarbon feedstock according to the present invention.

Although the following detailed description contains many specific details for purposes of illustration, it is understood that one of ordinary skill in the art will appreciate that many examples, variations and alterations to the following details are within the scope and spirit of the invention. Accordingly, the exemplary embodiments of the invention described herein and provided in the appended figures are set forth without any loss of generality, and without imposing limitations, relating to the claimed invention.

The present invention addresses problems associated with prior art methods upgrading a hydrocarbon feedstock. In one aspect, the present invention provides a method for upgrading a hydrocarbon containing petroleum feedstock. More specifically, in certain embodiments, the present invention provides a method for upgrading a petroleum feedstock utilizing supercritical water in the presence of a hydrogen donating composition, by a process which specifically excludes the use of an external supply of hydrogen gas, and also specifically excludes the use of catalyst for the reaction, and results in an upgraded hydrocarbon product having reduced coke production, and/or significant removal of impurities, such as, compounds containing sulfur, nitrogen and metals. In general, the use of hydrogen gas is avoided for use with the hydrothermal process due to economic and safety concerns. In addition, the methods described herein result in various other improvements in the petroleum product, including higher API gravity, higher middle distillate yield (as compared with the middle distillate present in both the feedstock and comparable upgrading processes), and hydrogenation of unsaturated compounds present in the petroleum feedstock.

Hydrocracking is a well known chemical process wherein complex organic molecules or heavy hydrocarbons are broken down into simpler molecules (e.g., heavy hydrocarbons are broken down into lighter hydrocarbons, for example, methane, ethane, and propane, as well as higher value products, such as, naphtha-range hydrocarbons, and diesel-range hydrocarbons) by the breaking of carbon-carbon bonds. Typically, hydrocracking processes require the use of both very high temperatures and specialized catalysts. The hydrocracking process can be assisted by use of elevated pressures and additional hydrogen gas, wherein, in addition to the reduction or conversion of heavy or complex hydrocarbons into lighter hydrocarbons, the added hydrogen can also function to facilitate the removal of at least a portion of the sulfur and/or nitrogen present in a hydrocarbon containing petroleum feed. Hydrogen gas, however, can be expensive and can also be difficult and dangerous to handle at high temperatures and high pressures.

In one aspect, the present invention utilizes supercritical water as the reaction medium to upgrade petroleum, and specifically excludes the use of a catalyst or an external source of hydrogen gas. The critical point of water is achieved at reaction conditions of approximately 374° C. and 22.1 MPa. Above those conditions, the liquid and gas phase boundary of water disappears, and the fluid has characteristics of both fluid and gaseous substances. Supercritical water is able to dissolve organic compounds like an organic solvent and has excellent diffusibility like a gas. Regulation of the temperature and pressure allows for continuous "tuning" of the properties of the supercritical water to be more liquid or more gas like. Supercritical water also has increased acidity, reduced density and lower polarity, as compared to liquid-phase sub-critical water, thereby greatly extending the possible range of chemistry which can be carried out in water. In certain embodiments, due to the variety of properties that are available by controlling the temperature and pressure, supercritical water can be used without the need for and in the absence of organic solvents.

Supercritical water has various unexpected properties, and, as it reaches supercritical boundaries and above, functions and behaves quite differently than subcritical water. For example, supercritical water has very high solubility toward organic compounds and has an infinite miscibility with gases. Also, near-critical water (i.e., water at a temperature and a pressure that are very near to, but do not exceed, the critical point of water) has very high dissociation constant. This means water, at near-critical conditions, is very acidic. This high acidity of the water can be utilized as a catalyst for various reactions. Furthermore, radical species can be stabilized by supercritical water through the cage effect (i.e., a condition whereby one or more water molecules surrounds the radical species, which then prevents the radical species from interacting). Stabilization of radical species is believed to help to prevent inter-radical condensation and thus, reduce the overall coke production in the current invention. For example, coke production can be the result of the inter-radical condensation, such as in polyethylene. In certain embodiments, supercritical water generates hydrogen gas through a steam reforming reaction and water-gas shift reaction, which is then available for the upgrading of petroleum.

As used herein, the terms "upgrading" or "upgraded", with respect to petroleum or hydrocarbons refers to a petroleum or hydrocarbon product that is lighter (i.e., has fewer carbon atoms, such as methane, ethane, and propane, but also including naphtha-range and diesel-range produces), and has at least one of a higher API gravity, higher middle distillate yield, lower sulfur content, lower nitrogen content, or lower metal content, than does the original petroleum or hydrocarbon feedstock.

The petroleum feedstock can include any hydrocarbon crude that includes either impurities (such as, for example, compounds containing sulfur, nitrogen and metals, and combinations thereof) and/or heavy hydrocarbons. As used herein, heavy hydrocarbons refers to hydrocarbons having a boiling point of greater than about 360° C., and can include aromatic hydrocarbons, as well as alkanes and alkenes. Generally, the petroleum feedstock can be selected from whole range crude oil, topped crude oil, product streams from oil refineries, product streams from refinery steam cracking processes, liquefied coals, liquid products recovered from oil or tar sand, bitumen, oil shale, asphaltene, hydrocarbons that originate from biomass (such as for example, biodiesel), and the like, and mixtures thereof.

While the hydrocarbon feedstock can be upgraded by treatment with supercritical water alone, the upgrading process in supercritical water is limited by the availability of hydrogen in the main hydrothermal reactor. Thus, the presence of additional hydrogen, such as from a hydrogen donating composition, can greatly increase the efficiency of the upgrading process. The hydrogen donating composition ("HDC") can be selected from the residual fraction of distillate, hydrocracker, coker, visbreaker, hydrotreater, and FCC products. Typically, the HDC is a highly viscous fluid, which may otherwise find use as a lube oil base stock. In general, the HDC is highly aliphatic due to the relatively severe hydrotreatment that occurs, for example, in a hydrocracker. The HDC stream preferably includes a sufficient amount of partially hydrogenated multi-ring aromatic compounds, such as tetralin (tetrahydronaphthalene) and alkylated tetralin, as well as paraffinic hydrocarbons. Tetralin, upon the donation of 4 hydrogens to other chemical compounds, has the chemical structure of naphthalene. In certain embodiments, the HDC is selected from tetralin, alkylated tetralin, such as 6-butyl, 7-ethyl tetralin, and normal paraffins such as n-eicosane(n-C21), n-docosane(n-C22), and n-octacosane(n-C28), and mixtures thereof. Other possible hydrogen donating compositions can include n-paraffins that are able to donate hydrogen through aromatization and dehydrogenation. Preferred n-paraffins includes those having six or greater carbon atoms.

As noted above, in certain embodiments, a bottoms stream from various processes designed to treat a heavy hydrocarbon feedstock, such as from a hydrocracker, can be utilized as the hydrogen donating composition. In preferred embodiments, the bottoms stream is pre-heated prior to being supplied to the hydrothermal reactor as the hydrogen donating composition. Without wishing to be bound by any specific theory, it is believed that the pretreatment of the bottoms stream, which can include maintaining the hydrogen donating composition at an elevated temperature for up to about 90 minutes, can help to generate partially hydrogenated aromatic compounds from the various aromatic compounds present, as well as the more active n-paraffinic compounds that are present. It is believed that during the pre-treatment of the bottoms stream, the compounds therein may undergo cracking, dehydrogenation, cyclization, isomerization, oligomerization, and/or aromatization. Alternatively, the pre-treatment heating of the HDC stream may result in some cyclization of various aliphatic hydrocarbons into naphthenic compounds or aromatic compounds. It is understood that there may be production of some partially aromatic compounds from the bottoms stream in the main hydrothermal reactor, however utilization of a pre-treatment step to increase the effectiveness of the bottoms streams compounds allows for the size of the main hydrothermal reactor to be minimized as no space in the reactor is dedicated to the production of the partially aromatized compounds from the bottoms stream by hydrogenation or other chemical process.

In an alternate process, a hydrocracker bottoms stream being utilized as the HDC can be pre-treated by first being supplied to a catalytic dehydrogenation unit, wherein naphthenic compounds contained therein can be converted into partially hydrogenated aromatic compounds. Catalytic dehydrogenation, however, is a much more expensive process than simply pre-heating the HDC stream.

In the main hydrothermal reactor, through thermal reaction with the supercritical water, the hydrocarbon feedstock undergoes multiple reactions, including cracking, isomerization, alkylation, hydrogenation, dehydrogenation, disproportionation, dimerization and oligomerization. While the hydrothermal treatment with supercritical water is operable to generate hydrogen, carbon monoxide, carbon dioxide, hydrocarbons, and water through a steam reforming process, the addition of the hydrogen donating composition provides additional hydrogen atoms for the upgrading process. Heteroatoms and metals, such as sulfur, nitrogen, vanadium, and nickel, can be transformed by the process and released.

In one embodiment, the invention discloses a method for the hydrothermal upgrading of a hydrocarbon feedstock by a hydrothermal method, wherein the method does not include an external supply of hydrogen and catalyst. The method includes the steps of providing and pumping a hydrocarbon feedstock, water, and a stream comprising a hydrogen donating composition by separate pumps, wherein the hydrocarbon feedstock, water, and hydrogen donating compositions can each optionally be heated and pressurized to predetermined temperatures and pressures by separate heating devices. The hydrocarbon feedstock, water and hydrogen donating composition are combined and mixed to provide a mixed stream, which can then be heated and pressurized to a temperature and pressure that is near or greater than the supercritical temperature and pressure of water. The mixed stream is injected into the main hydrothermal reactor, wherein the hydrocarbon feedstock undergoes upgrading by reaction in the supercritical water, to produce modified hydrocarbon stream that includes upgraded hydrocarbons relative to the hydrocarbon feedstock. The modified hydrocarbon stream can be sent to cooling device to produce cooled modified hydrocarbon stream. The modified hydrocarbon stream can be depressurized to produce a depressurized modified hydrocarbon stream. The depressurized and cooled modified hydrocarbon stream can be discharged as an upgraded hydrocarbon discharge stream, which includes gas phase hydrocarbons, liquid hydrocarbons, and water. The upgraded hydrocarbon discharge stream can be separated to produce a gas phase stream and a liquid phase stream. The liquid phase stream can be separated into a water stream and a hydrocarbon product stream.

Referring now to FIG. 1, in one embodiment, apparatus 100 is provided for the hydrothermal upgrading of a hydrocarbon feedstock. Hydrocarbon feedstock 110 is provided to first mixer 114 where the hydrocarbon feedstock and hydrogen donating composition 112 are mixed, preferably intimately mixed, to produce first mixed stream 116, which includes the hydrocarbon feedstock and the hydrogen donating composition. The mixer can be a simple T-fitting or like device, as is known in the art. The mixer can optionally include means for increased inline mixing between components being supplied thereto, such as vortex generators.

First mixed stream 116 is supplied to second mixer 120 where the first mixed stream is combined and intimately mixed with water 118 to produce second mixed stream 122. Apparatus 100 can include various pumps and valves for supplying hydrocarbon feedstock 110, hydrogen donating composition 112, and water 118 to the various mixers. Additionally, apparatus 100 can include various heaters, heat exchanges, or like devices for heating one or more of the component streams of hydrocarbon feedstock 110, hydrogen donating composition 112, and water 118. For example, each of the lines for supplying a heated stream of hydrocarbon feedstock 110, hydrogen donating composition 112, and water 118 can include a heater (not shown) or like means for heating to provide a preheated feed. Similarly, apparatus 100 can include one or more pumps (not shown) or like means for providing a pressurized stream of hydrocarbon feedstock 110, hydrogen donating composition 112, or water 118.

In certain embodiments, the hydrocarbon feedstock can be preheated to a temperature of up to about 250° C., alternatively between about 50 and 200° C., or alternatively between about 100 and 175° C., prior to being supplied to mixer 114. In other embodiments, the hydrocarbon feedstock can be preheated to a temperature of between about 100 and 150° C., alternatively between about 150 and 200° C., or alternatively between about 175 and 225° C., prior to being supplied to mixer 114.

In certain embodiments, the hydrogen donating composition can be preheated to a temperature of up to about 500° C., alternatively between about 50 and 400° C., or alternatively between about 120 and 350° C., prior to being supplied to mixer 114. In other embodiments, the hydrogen donating composition can be preheated to a temperature of between about 100 and 250° C., alternatively between about 200 and 350° C., or alternatively between about 350 and 450° C., prior to being supplied to mixer 114.

In certain embodiments, the water can be preheated to a temperature of greater than about 250° C., optionally between about 250° C. and 650° C., alternatively between about 300° C. and 600° C., or between about 400° C. and 550° C., prior to being supplied to second mixer 120. In other embodiments, the water can be preheated to a temperature of between about 250° C. and 350° C., alternatively between about 350° C. and 450° C., alternatively between about 450° C. and 550° C., or alternatively between about 550° C. and 650° C., prior to being supplied to second mixer 120.

Second mixed stream 122, which includes the hydrocarbon feedstock, the hydrogen donating composition, and water, supplied from second mixer 120 to hydrothermal reactor 124, can include various heaters, as noted above, for heating the second mixed stream. In certain embodiments, second mixed stream 122 is heated to a temperature of at least about 350° C., alternatively at least about 370° C., alternatively at least about 374° C., or greater.

Heating of the hydrocarbon feedstock 110, hydrogen donating composition 112, water 118, and/or second mixed stream 122 can be provided by a strip heater, immersion heater, tubular furnace, heating tape, heat exchanger, or like device capable of raising the temperature of the fluid.

In certain embodiments, the hydrocarbon feedstock, hydrogen donating composition, and water streams can each separately be pressurized to a pressure of greater than atmospheric pressure, preferably at least about 15 MPa, alternatively greater than about 20 MPa, or alternatively greater than about 22 MPa. In certain embodiments, the hydrocarbon feedstock, hydrogen donating composition, and water can each separately be pressurized to a pressure of greater than 22.1 MPa, alternatively between about 23 and 30 MPa, or alternatively between about 24 and 26 MPa.

Second mixed stream 122, which includes the hydrocarbon feedstock, the hydrogen donating composition, and water, supplied from second mixer 120 to hydrothermal reactor 124, can include various pumps, as noted above, for pressurizing the second mixed stream. In certain embodiments, second mixed stream 122 is pressurized to a pressure of at least 15 MPa, alternatively at least about 20 MPa, alternatively at least about 22.1 MPa, or greater.

Second mixed stream 122 is supplied to hydrothermal reactor 124, which is maintained at a temperature and pressure such that the water is in its supercritical state. Hydrothermal reactor 124 can be a horizontal or vertical tubular type reactor, or vessel type reactor. In certain embodiments, hydrothermal reactor 124 includes a mechanical stirrer or like means for mixing the reactants.

Hydrothermal reactor 124 is maintained at a temperature of at least 374° C. and a pressure of at least 22.1 MPa. Alternatively, hydrothermal reactor 124 is maintained at a temperature of between about 380° C. and 550° C., alternatively between about 390° C. and about 500° C., or alternatively between about 400° C. and 450° C. In certain embodiments, hydrothermal reactor 124 is maintained at a pressure of between about 23 MPa and 30 MPa, alternatively between about 24 MPa and 26 MPa. Means for heating hydrothermal reactor 124 can include a strip heater, immersion heater, tubular furnace, heat exchanger, or like device known in the art.

Second mixed stream 122 is maintained in hydrothermal reactor 124 for a residence time of between about 1 second and 120 minutes, alternatively between about 30 seconds and 60 minutes, alternatively between about 1 min and 30 minutes. In alternate embodiments, second mixed stream 122 is maintained in hydrothermal reactor 124 for between about 2 and 10 minutes, alternatively between about 10 and 20 minutes, or alternatively between about 20 and 30 minutes.

Third mixed stream 126 exiting hydrothermal reactor 124 includes upgraded hydrocarbons and water. Additionally third mixed stream 126 exiting hydrothermal reactor 124 can include unconverted HDC and converted (dehydrogenated) HCD. Third mixed stream 126 can optionally be supplied to a cooling device (not shown), such as a chiller or heat exchanger, to reduce the temperature of the third mixed stream. For example, third mixed stream 126 can exit hydrothermal reactor 124 as a heated and pressurized stream, which can be supplied to one or more heat exchangers to heat one or more of the streams selected from hydrocarbon feedstock 110, hydrogen donating composition 112, or water 118. Upon exiting the optionally cooling device, the temperature of third mixed stream 126 can be less than about 250° C., alternatively less than about 200° C., or alternatively less than about 150° C. In certain embodiments, the temperature of third mixed stream 126 is between about 5° C. and 150° C., alternately between about 10° C. and 100° C., or alternatively between about 25° C. and 75° C. upon leaving the optional cooling device.

Third mixed stream 126, upon exiting hydrothermal reactor 124, can optionally be supplied to a depressurizing device (not shown) to decrease the pressure of the stream. For example, in certain embodiments, third mixed stream 126 can be supplied a pressure regulating valve, capillary tube, or like device to reduce the pressure of the third mixed stream. In certain embodiments, the depressurizing device can be used in conjunction with a cooling device to provide a depressurized and cooled mixed stream. In certain embodiments, upon exiting the optional depressurizing device, third mixed stream 126 can have a pressure of between about 0.1 MPa and 0.5 MPa, alternatively between about 0.1 MPa and 0.2 MPa.

Third mixed stream 126 is supplied to a separator 128, wherein gas phase components 130 can be separated from liquid phase components, and the liquid phase components can be further separated into water phase 132 and organic phase 134, which can include upgraded hydrocarbons. Separator 128 can be a settling tank or like device, and include means for separately withdrawing gas, hydrocarbon and/or water fractions.

Figure 2:
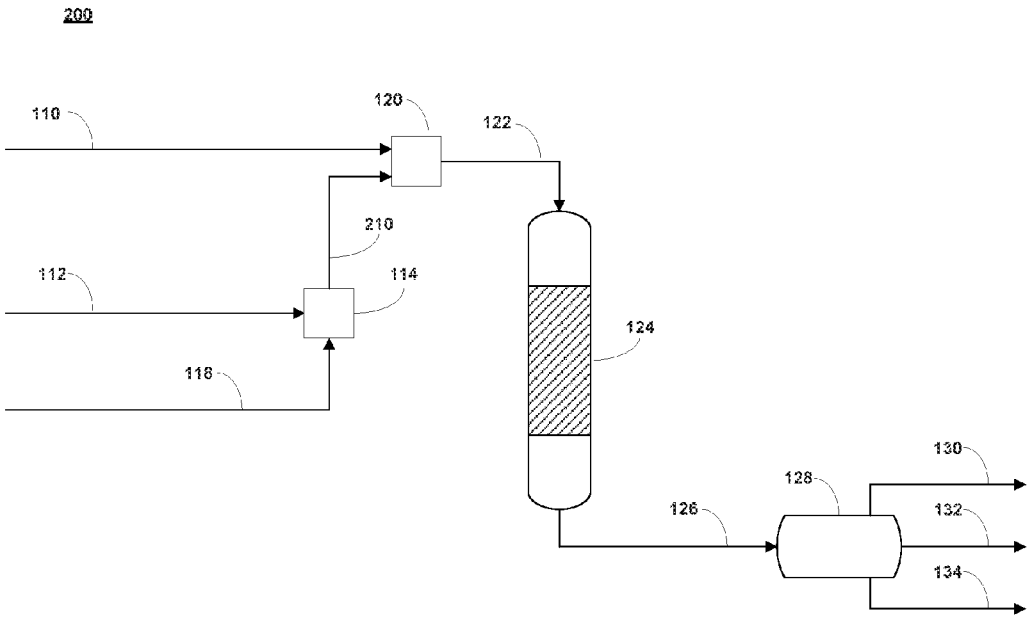
FIG. 2 provides a schematic diagram of a second embodiment of the method of upgrading a hydrocarbon feedstock according to the present invention.

Referring now to FIG. 2, in one embodiment, apparatus 200 is provided for the hydrothermal upgrading of hydrocarbon feedstock 110. The process is similar to that which is provided for apparatus 100, as shown above in FIG. 1, except as described below. Hydrogen donating composition 112 and water 118 can be supplied to first mixer 114, where the two streams are mixed, preferably intimately mixed, to provide a first mixed stream 210. First mixed stream 210 can then be supplied to second mixing means 120 where the first mixed stream is combined with hydrocarbon feedstock 110, preferably intimately mixed, to provide second mixed stream 122. As noted above, one or more of hydrocarbon feedstock 110, hydrogen donating composition 112, water 118, first mixed stream 210, and second mixed stream 122 can each separately be heated and/or pressurized prior to being supplied to hydrothermal reactor 124. Second mixed stream 122 can be further processed in hydrothermal reactor 124 as described above with respect to apparatus 100 shown in FIG. 1.

Figure 3:
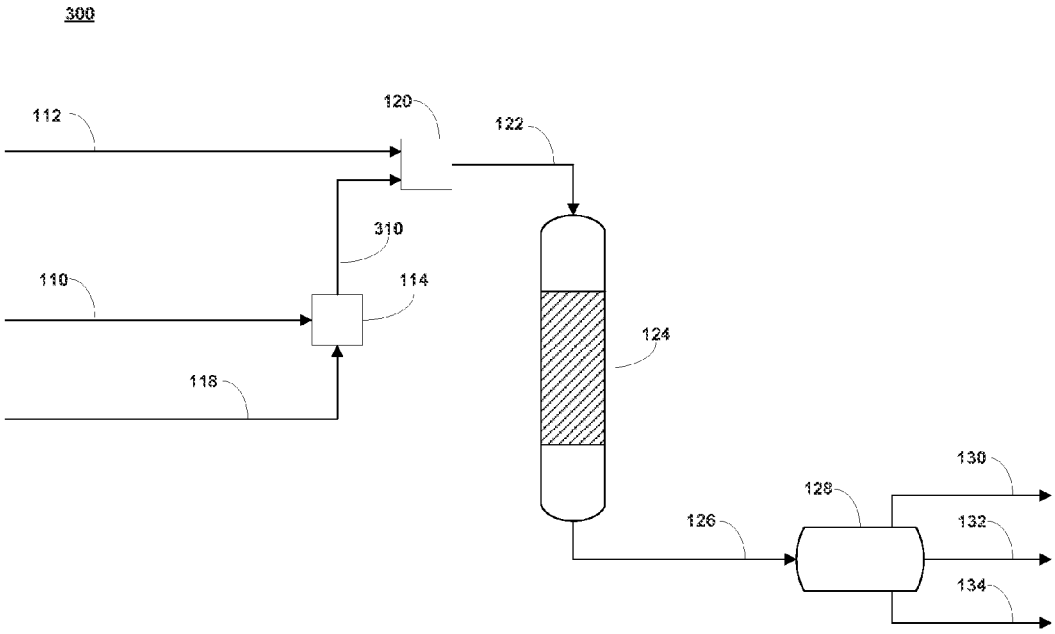
FIG. 3 provides a schematic diagram of a second embodiment of the method of upgrading a hydrocarbon feedstock according to the present invention.

Referring now to FIG. 3, in one embodiment, apparatus 300 is provided for the hydrothermal upgrading of hydrocarbon feedstock 110. The process is similar to that which is provided for apparatus 100, as shown above in FIG. 1, except as described below. Hydrocarbon feedstock 110 and water 118 can be supplied to first mixer 114, where the two streams are mixed, preferably intimately mixed, to provide a first mixed stream 310. First mixed stream 310 can then be supplied to second mixing means 120 where the first mixed stream is combined with hydrogen donating composition 112, preferably intimately mixed, to provide second mixed stream 122. As noted above, one or more of hydrocarbon feedstock 110, hydrogen donating composition 112, water 118, first mixed stream 310, and second mixed stream 122 can each separately be heated and/or pressurized prior to being supplied to hydrothermal reactor 124. Second mixed stream 122 can be further processed in hydrothermal reactor 124 as described above with respect to apparatus 100 shown in FIG. 1.

Figure 4:
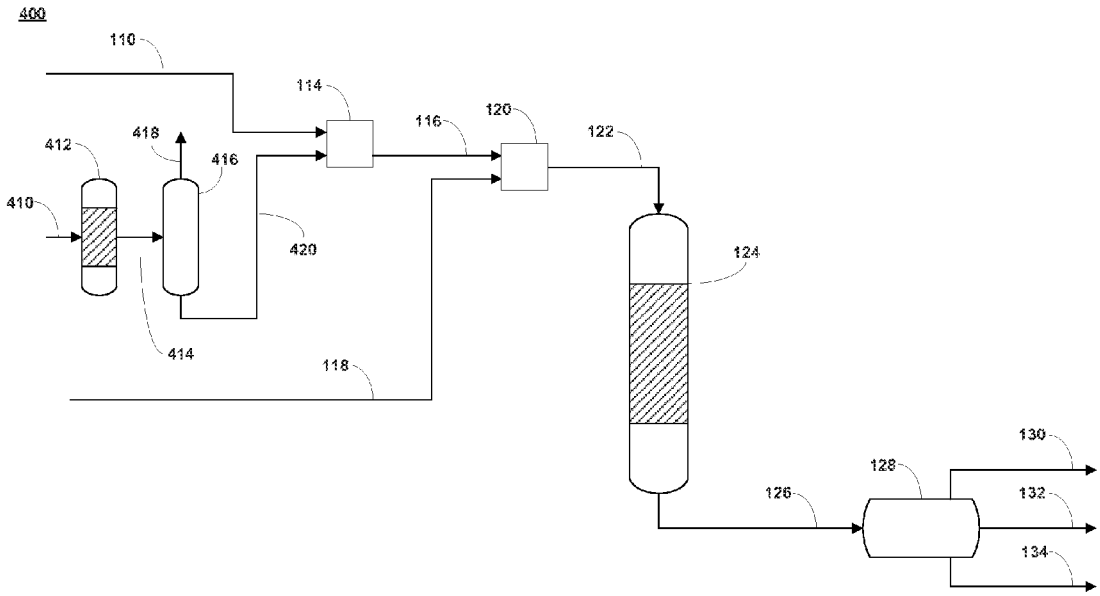
FIG. 4 provides a schematic diagram of a second embodiment of the method of upgrading a hydrocarbon feedstock according to the present invention.

Referring now to FIG. 4, in one embodiment, apparatus 400 is provided for the hydrothermal upgrading of a hydrocarbon feedstock. The process is generally similar to that which is provided in FIG. 1, and described above, but includes additional steps for the preparation and isolation of a hydrogen donating composition, as described below. Second hydrocarbon feedstock 410, typically a low value hydrocarbon feed, such as an atmospheric residue or vacuum residue, is supplied to reactor 412 for the preparation of light petroleum product stream 414. Reactor 412 can be selected from any known reactor for processing low grade hydrocarbons to higher value light petroleum products, such as a hydrocracker, coker, visbreaker, hydrotreater, FCC unit, or the like. Second hydrocarbon feedstock 410 is preferably a low grade or low value hydrocarbon, although it is understood that any petroleum based hydrocarbon can be used. Low grade or low value hydrocarbons are particularly preferred for economic reasons. Light petroleum product stream 414 can be supplied to distillation column 416, which is operable to separate the light petroleum product stream into a light fraction 418 and a bottoms stream 420. Bottoms stream 420 can include compounds suitable for use as hydrogen donating compositions, and can be supplied directly to first mixer 114, where the bottoms stream is mixed with hydrocarbon feedstock 110 to provide first mixed stream 116. In alternate embodiments, bottoms stream 420 can be further treated if necessary, prior to being supplied to first mixer 114. In certain embodiments, bottoms stream 420 can pre-heated to increase the concentration of suitable hydrogen donating compounds in the hydrogen donating composition, such as partially aromatized compounds and n-paraffinic compounds. Thus, in certain embodiments, apparatus 400 can include a heating device (not shown) to pre-treat bottoms stream 420. Alternatively, apparatus 400 can include a vessel that includes a heating device such that a portion of bottoms stream 420 can be maintained at an elevated temperature for a pre-determined amount of time. First mixed stream 116 can then be supplied to second mixer 120, where it can be combined, and preferably intimately mixed, with water feed 118, and can be further processed as described with respect to apparatus 100 shown in FIG. 1 and described above. As noted above, one or more of hydrocarbon feedstock 110, second hydrocarbon feedstock 410, bottoms stream 420, water 118, first mixed stream 310, and second mixed stream 122 can each separately be heated and/or pressurized prior to being supplied to hydrothermal reactor 124. In certain embodiments, light fraction 418 can be combined with a diesel or gasoline fraction. In other embodiments, light fraction 418 can be supplied to hydrothermal reactor 124 (not shown).

Reactor 412 can include any equipment associated with processing a hydrocarbon feedstock, particularly a heavy hydrocarbon feedstock or a low grade or low value hydrocarbon feedstock, to produce a stream that includes compounds useful for use as a hydrogen donating composition. Exemplary processes for upgrading a heavy hydrocarbon feed can include hydrocracking, visbreaking, FCC, hydrotreating and coking processes. Typically, a heavy distillate fraction such as an atmospheric or vacuum residue, having a boiling point that is greater than about 360° C. is supplied to reactor 412, wherein certain predetermined conditions are maintained such that the heavy hydrocarbon feed is upgraded to a lighter hydrocarbon product, although, as noted above, other hydrocarbon sources can be supplied to reactor 412. The fraction remaining after the distillation of the product stream typically includes compounds having a high hydrogen:carbon ratio and are suitable for use as hydrogen donating compounds.

Figure 5:
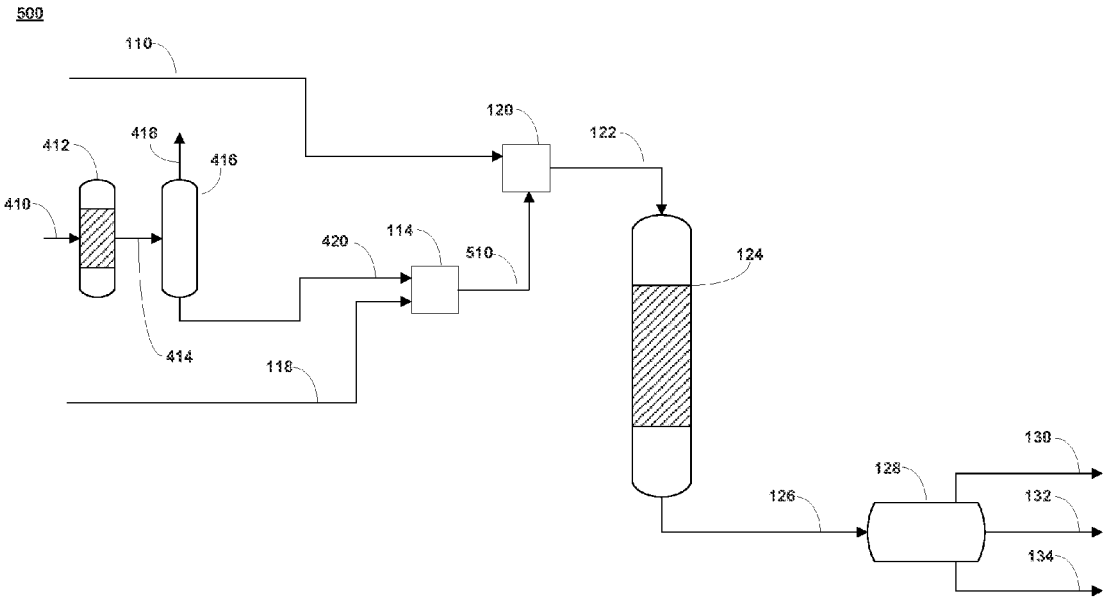
FIG. 5 provides a schematic diagram of a second embodiment of the method of upgrading a hydrocarbon feedstock according to the present invention.

Referring now to FIG. 5, in one embodiment, apparatus 500 is provided for the hydrothermal upgrading of a hydrocarbon feedstock. The process is generally similar to that which is provided in FIG. 4, and described above, but includes additional steps, as described below. As noted above, second hydrocarbon feedstock 410, is supplied to reactor 412 for the preparation of light petroleum product stream 414, which is then separated to provide a bottoms stream 420, which may be utilized as a hydrogen donating composition. Bottoms stream 420 can be supplied directly to first mixer 114, where the bottoms stream is mixed, preferably intimately, with water 118 to provide first mixed stream 510. In alternate embodiments, bottoms stream 420 can be further treated if necessary, prior to being supplied to first mixer 114. Optionally, bottoms stream 420 can pre-heated to increase the concentration of suitable hydrogen donating compounds in the hydrogen donating composition, such as partially aromatized compounds. Thus, in certain embodiments, apparatus 500 can include a heating device (not shown) to pre-treat bottoms stream 420. Alternatively, apparatus 500 can include a vessel that includes a heating device such that a portion of bottoms stream 420 can be maintained at an elevated temperature for a pre-determined amount of time. First mixed stream 510, comprising water and bottoms stream 420, can then be supplied to second mixer 120, where it can be combined, and preferably intimately mixed, with water feed 118, and can be further processed as described with respect to apparatus 100 shown in FIG. 1 and described above. As noted above, one or more of hydrocarbon feedstock 110, second hydrocarbon feedstock 410, bottoms stream 420, water 118, first mixed stream 510, and second mixed stream 122 can each separately be heated and/or pressurized prior to being supplied to hydrothermal reactor 124.

Figure 6:
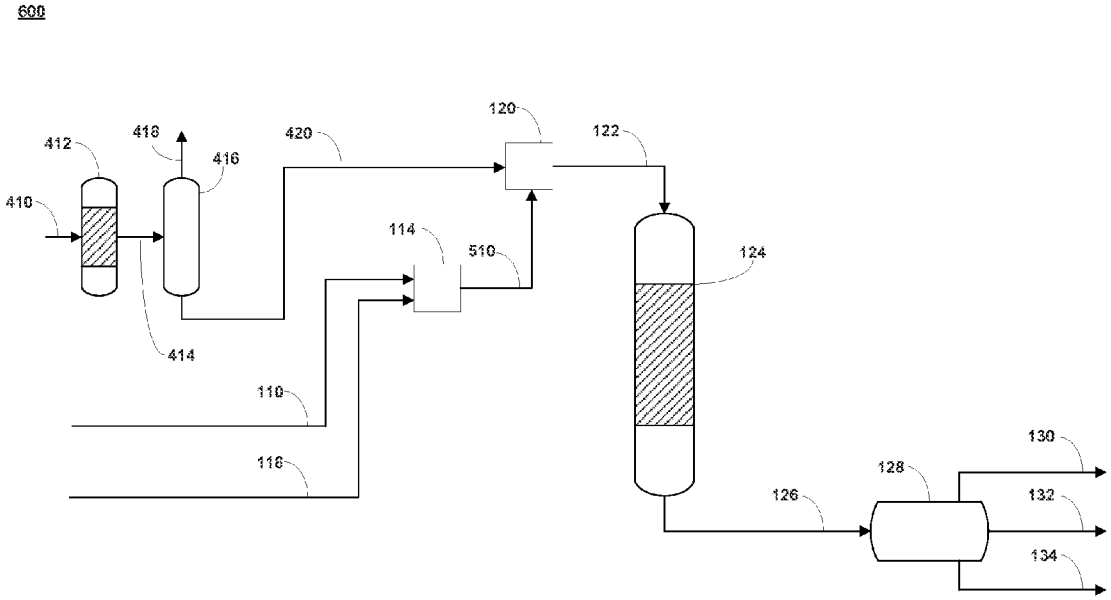
FIG. 6 provides a schematic diagram of a second embodiment of the method of upgrading a hydrocarbon feedstock according to the present invention.

Referring now to FIG. 6, in one embodiment, apparatus 600 is provided for the hydrothermal upgrading of a hydrocarbon feedstock. The process is generally similar to that which is provided above and shown in FIGS. 4 and 5 but includes additional steps, as described herein. As noted above, second hydrocarbon feedstock 410, is supplied to reactor 412 for the preparation of light petroleum product stream 414, which is then separated to provide a bottoms stream 420, which may be utilized as a hydrogen donating composition. Bottoms stream 420 can be supplied second mixing means 120. Hydrocarbon feedstock 110 and water 118 can be supplied to first mixer 114, where the two streams are mixed, preferably intimately, to provide a first mixed stream 310. First mixed stream 310 can then be supplied to second mixing means 120 where the first mixed stream is combined with bottoms stream 420. As noted above, bottoms stream 420 may be utilized as a hydrogen donating composition. Second mixer 120 mixes first mixed stream 310 and bottoms stream 420, preferably intimately, to produce second mixed stream 122. In alternate embodiments, bottoms stream 420 can be further treated if necessary, prior to being supplied to first mixer 114. Optionally, bottoms stream 420 can pre-heated to increase the concentration of suitable hydrogen donating compounds in the hydrogen donating composition, such as partially aromatized compounds. Thus, in certain embodiments, apparatus 600 can include a heating device (not shown) to pre-treat bottoms stream 420. Alternatively, apparatus 600 can include a vessel that includes a heating device such that a portion of bottoms stream 420 can be maintained at an elevated temperature for a pre-determined amount of time. Second mixed stream 122 can be further processed as described with respect to apparatus 100 shown in FIG. 1 and described above. As noted above, one or more of hydrocarbon feedstock 110, second hydrocarbon feedstock 410, bottoms stream 420, water 118, first mixed stream 310, and second mixed stream 122 can each separately be heated and/or pressurized prior to being supplied to hydrothermal reactor 124.

In certain embodiments, the hydrogen donating composition can be pre-heated prior to being supplied to hydrothermal reactor 124. In certain embodiments, hydrogen donating composition 112, or bottoms stream 420, can be supplied to a pre-heating step that includes maintaining the hydrogen donating compound in a pre-heating zone for a period of between about 1 and 240 minutes, alternatively between about 10 and 90 minutes, and supplying sufficient heat, as noted below. In certain embodiments, hydrogen donating composition 112 or bottoms stream 420 is maintained in a pre-heating zone for between about 5 and 30 minutes, alternatively between about 30 and 60 minutes, alternatively between about 60 and 90 minutes, alternatively between about 90 and 120 minutes. In certain embodiments, the pre-heating step includes maintaining hydrogen donating composition 112 or bottoms stream 420 in a pre-heating zone for a specified amount of time at a temperature of up to about 500° C., alternatively between about 50° C. and 400° C., or alternatively between about 120° C. and 350° C. Pre-heating of hydrogen donating composition 112 or bottoms stream 420 may help to generate a greater amount of more efficient hydrogen donating compounds. In certain embodiments, first mixed stream 116, which includes a mixture of hydrocarbon feedstock 110 and hydrogen donating composition 112, can be supplied to the pre-heating step described above.

The ratio of the volumetric flow rate of the hydrocarbon feedstock to water for the process, at standard conditions, is between about 1:10 and 10:1, alternatively between about 5:1 and 1:5, alternatively between about 1:2 and 2:1. In certain embodiments, the ratio of the volumetric flow rate of hydrocarbon feedstock to water, at standard conditions, is between about 1:10 and 10:1, alternatively between about 1:2 and 2:1.

The weight ratio of the hydrogen donating composition to the hydrocarbon feedstock for the process, at standard conditions, is between about 0.005:1 and 0.1:1, alternatively between about 0.005:1 and 0.01:1, alternatively between about 0.01:1 and 0.05:1, alternatively between about 0.05:1 and 0.1:1. In certain embodiments, the weight ratio of the hydrogen donating composition to the hydrocarbon feedstock, at standard conditions, is between about 0.01:1 and 0.05:1. In general, the ratio of the HDC/hydrocarbon feedstock depends upon the number of hydrogen atoms available from the HDC, as well as the desired amount of upgrading of the hydrocarbon feedstock.

One advantage of certain embodiments of the present invention includes significant cost savings utilizing a bottoms stream from an associated low value or low grade hydrocarbon upgrading process. Certain known individual hydrogen donating compounds, for example tetralin, can be expensive and difficult to supply to an on-site upgrading process. Additionally, these compounds can be very difficult to recover and regenerate as they frequently require external hydrogen and a catalyst. By utilizing the bottoms stream from an associated process, traditional steps to separate and isolate the specific hydrogen donating compounds is eliminated, thus saving significant time and expense. Furthermore, because of the expense spared on the front end, there may be little need or desire to recover and regenerate the hydrogen donating compositions. Instead, the resulting dehydrogenated compounds (for example, naphthalene in the case where tetralin is utilized as the hydrogen donating compositions) can remain in the upgraded hydrocarbon product.

EXAMPLES

The examples below show upgrading of heavy crude according to an embodiment of the present invention.

Example 1

Prior art upgrading with supercritical water. A whole range Arabian heavy crude oil and deionized water were pressurized by to a pressure of about 25 MPa. Volumetric flow rates of crude oil and deionized water at standard conditions were approximately 3.1 and 6.2 mL/minute, respectively. The crude oil stream was preheated in a first pre-heater to a temperature of about 150° C. and the deionized water stream was pre-heated to a temperature of about 450° C. The pre-heated crude oil and deionized water were combined by flowing though a tee fitting having an internal diameter of about 0.083 inches to form a combined stream having a temperature of about 379° C., which was above critical temperature of water. The combined stream was supplied to a vertically oriented main hydrothermal reactor having an internal volume of about 200 mL. Residence time in the main hydrothermal reactor was about 10 minutes. An upgraded hydrocarbon stream exiting the main hydrothermal reactor had a temperature of about 380° C., and was supplied to a chiller, which produced a cooled upgraded hydrocarbon steam having a temperature of about 60° C. The cooled upgraded hydrocarbon stream was depressurized by back pressure regulator to atmospheric pressure. The depressurized cooled upgraded hydrocarbon stream was separated into gas, oil and water phase products yielding a total liquid yield (oil and water) was around 95% by weight after operation of the process for about 12 hours. The resulting upgraded hydrocarbon had a total sulfur content of about 1.91%, an API gravity of about 23.5, and a T80 Distillation temperature of about 639° C.

Example 2

A whole range Arabian heavy crude oil stream, a deionized water stream, and a hydrogen donating composition were each separately pressurized by metering pumps to a pressure of about 25 MPa. Volumetric flow rates of crude oil and deionized water at standard conditions were about 3.1 and 6.2 mL/minute, respectively. A bottoms stream from a hydrocracking unit having paraffinic hydrocarbons as the main component was supplied as the hydrogen donating composition and was supplied at a volumetric flow rate of about 0.05 ml/minute. The pressurized crude oil, deionized water, and hydrogen donating compositions were pre-heated in separate heaters, wherein the crude oil was pre-heated to a temperature of about 150° C., the deionized water was preheated to a temperature of about 450° C., and the hydrogen donating composition was pre-heated to a temperature of about 300° C. The crude oil stream and hydrogen donating composition were combined in a first simple tee fitting mixing device having about 0.083 inch internal diameter to produce a first mixed stream having a temperature of about 178° C. The first mixed stream was combined with the pre-heated pressurized water in a mixing device have a temperature of about 380° C. and injected into a vertically oriented hydrothermal reactor having an internal volume of about 200 mL, and maintained in the reactor for about 10 minutes to produce a modified stream that includes upgraded hydrocarbons. The modified stream was cooled with a chiller to produce a cooled modified stream having a temperature of about 60° C. The cooled modified stream was depressurized to atmospheric pressure with a back pressure regulator. The cooled and depressurized modified stream was separated into separate gas, oil and water phase products. A total liquid yield (oil and water) of approximately 100% by weight was obtained after operation of the process for 12 hours. The resulting upgraded hydrocarbon had a total sulfur content of about 1.59%, an API gravity of about 24.1, and a T80 Distillation temperature of about 610° C.

As shown in Table 1, below, the results of thermal upgrading of the whole range Arabian heavy crude detailed in Examples 1 and 2 above, is compared with the properties of the whole range Arabian heavy crude prior to upgrading. As seen, the addition of the hydrogen donating composition increases the upgrading of the heavy crude. Utilizing the method of Example 2, above, resulting in the removal of an additional 17% sulfur, and a reduction in the T80 Distillation temperature of about 29° C.

TABLE 1

| | Total Sulfur Content | API Gravity | T80 Distillation (° C.) |
|---|---|---|---|
| Whole range Arabian heavy crude | 2.94 wt. % | 21.7 | 716 |
| Example 1 | 1.91 wt. % | 23.5 | 639 |
| Example 2 | 1.59 wt. % | 24.1 | 610 |

Although the present invention has been described in detail, it should be understood that various changes, substitutions, and alterations can be made hereupon without departing from the principle and scope of the invention. Accordingly, the scope of the present invention should be determined by the following claims and their appropriate legal equivalents.

The singular forms "a", "an" and "the" include plural referents, unless the context clearly dictates otherwise.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

Throughout this application, where patents or publications are referenced, the disclosures of these references in their entireties are intended to be incorporated by reference into this application, in order to more fully describe the state of the art to which the invention pertains, except when these reference contradict the statements made herein.

That which is claimed is:

1. A method for upgrading a hydrocarbon feedstock, the method comprising the steps of:

supplying a low grade first hydrocarbon feedstock to a first reactor selected from the group consisting of a hydrocracker, a coker, a visbreaker, a hydrotreater, and a catalytic cracker, wherein said first reactor configured for the upgrading of the low grade first hydrocarbon feedstock;

recovering an intermediate hydrocarbon stream from the first reactor;

separating the intermediate hydrocarbon stream into a light hydrocarbon stream and a bottoms stream, the bottoms stream comprises a hydrogen donating composition, wherein the hydrogen donating composition is selected from the group consisting of tetralin, alkylated tetralin, and combinations of the same;

pre-heating the bottoms stream to a temperature of at least about 120° C. for a period of at least about 10 minutes to produce a pre-heated bottoms stream;

mixing said pre-heated bottoms stream, a hydrocarbon feedstock, and water to form a reaction mixture;

supplying the reaction mixture to a main hydrothermal reactor maintained at a temperature greater than about 374° C. and a pressure greater than about 22.06 MPa for a residence time in the main hydrothermal reactor of between about 30 seconds and 60 minutes to produce a modified stream comprising upgraded hydrocarbons, wherein the main hydrothermal reactor does not include a catalyst;

withdrawing the modified stream;

separating the modified stream into a gaseous phase and a liquid phase; and separating the liquid phase into a water stream and an upgraded hydrocarbon stream, wherein the upgraded hydrocarbon stream has at least one improved physical property as compared with the hydrocarbon feedstock, the physical properties selected from sulfur content, nitrogen content, metal content, coke content, and API gravity.

2. The method of claim 1, wherein the method does not include supplying hydrogen gas to the main hydrothermal reactor.

3. The method of claim 1, further comprising, prior to the step of separating the modified stream:

depressurizing the modified stream; and reducing the temperature of the modified stream.

4. The method of claim 1, further comprising:

maintaining the pressure in the main hydrothermal reactor at between about 24 MPa and about 26 MPa; and maintaining the temperature in the main hydrothermal reactor at between about 380° C. and about 550° C.

5. The method of claim 1, wherein a volumetric ratio of the hydrocarbon feedstock to water supplied to the main hydrothermal reactor is between 1:10 and 10:1.

6. The method of claim 1, wherein a weight ratio of the hydrogen donating composition to the hydrocarbon feedstock is between about 0.005:1 and 0.1:1.

7. The method of claim 1, further comprising the steps of:

preheating the hydrocarbon feedstock stream to a temperature of up to about 250° C. to produce a preheated hydrocarbon feedstock stream;

preheating the bottoms stream to a temperature of up to about 500° C.;

preheating the water to a temperature of up to about 650° C.; and mixing the preheated hydrocarbon feedstock stream, the hydrogen donating composition, and the water to produce the reaction mixture.

8. The method of claim 1, wherein the residence time of the reaction mixture in the main hydrothermal reactor is between 1 minute and 30 minutes.

* * * * *